United States Patent [19]

Jarlan

[11] 4,279,536

[45] Jul. 21, 1981

[54] FLOW-GUIDING MONOLITHIC BLOCKS FOR MARINE STRUCTURES

[76] Inventor: Gerard E. Jarlan, Rue due Refuge, 78000 Versailles, France

[21] Appl. No.: 17,561

[22] Filed: Mar. 7, 1979

[30] Foreign Application Priority Data

Dec. 15, 1978 [CA] Canada ..... 318057

[51] Int. Cl.[3] ..... E02B 3/06; E02B 3/12

[52] U.S. Cl. ..... 405/31; 52/607; 405/21

[58] Field of Search ..... 405/15, 16, 22–35, 405/17–21; 52/607, 589, 606

[56] References Cited

U.S. PATENT DOCUMENTS

| | | | |
|---|---|---|---|
| 786,971 | 4/1905 | Jones | 52/607 |
| 815,641 | 3/1906 | Schoeneman | 52/607 |
| 2,159,685 | 5/1939 | Buzzell | 405/20 |
| 2,677,240 | 5/1954 | Danel | 405/30 |
| 3,099,063 | 7/1963 | Santhany | 52/607 X |
| 3,118,282 | 1/1964 | Jarlan | 405/31 |
| 3,386,250 | 6/1968 | Katayama | 405/33 |
| 4,018,018 | 4/1977 | Kosuge | 52/607 X |

FOREIGN PATENT DOCUMENTS

| | | | |
|---|---|---|---|
| 17162 | 3/1913 | Denmark | 405/34 |
| 2755833 | 7/1978 | Fed. Rep. of Germany | 405/15 |
| 1149155 | 4/1969 | United Kingdom | 405/34 |

*Primary Examiner*—Dennis L. Taylor
*Attorney, Agent, or Firm*—R. Filipkowski

[57] ABSTRACT

A ballasting block for use as chamber floor loading in a concrete caisson breakwater made up of horizontally-arrayed sections having perforated front walls, or for use as armor capping on rubble mound breakwaters, is of parallelepipedic form with two pairs of sides meeting at right angles, and front and rear end faces of rectilinear outline having openings recessed therein defined by at least one through passage extending the length of the block, serving as flow-guiding channel means. A preferred form for caisson ballasting as one or more layers of closely-spaced blocks, is a cube, or a rectangular prism, molded of concrete of weight from about one tonne to about twenty tonnes, having a single passage of circular, elliptical, or polygonal cross-sectional outline with area from 0.2 $m^2$ to 1.5 $m^2$. When used for armor capping each end face is perforated by a number of ducts, the blocks being laid in ordered arrays with close spacing presenting one end face upwardly. Each block has a groove recessed into the rear end face intersecting one pair of side faces and intersecting the single passage or some or all of the ducts, to distribute water vertically in the chamber when used as ballast, or to distribute water into rubble material of the mound.

22 Claims, 16 Drawing Figures

FIG.6
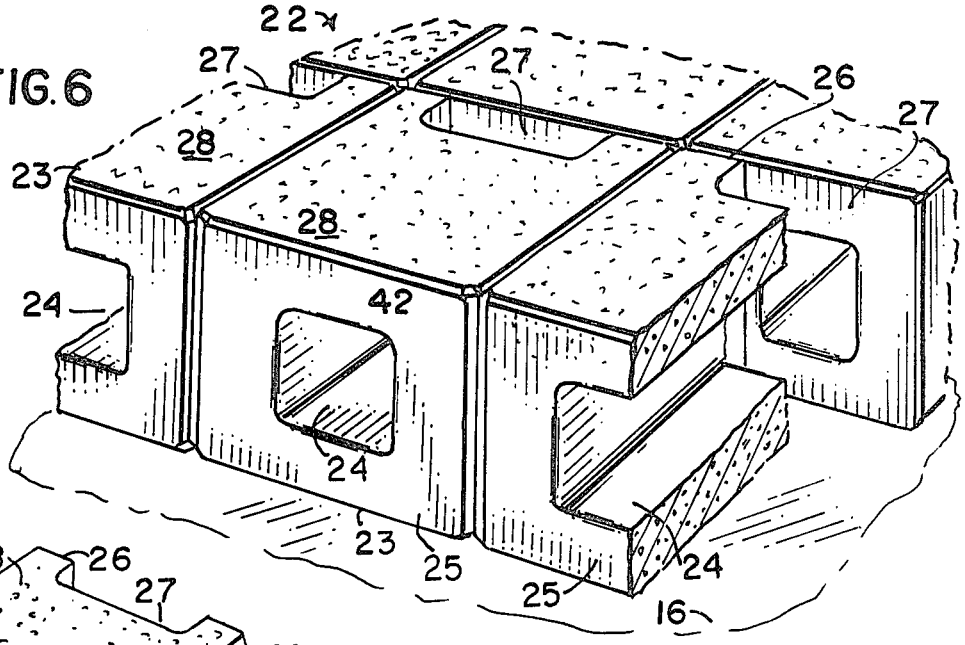
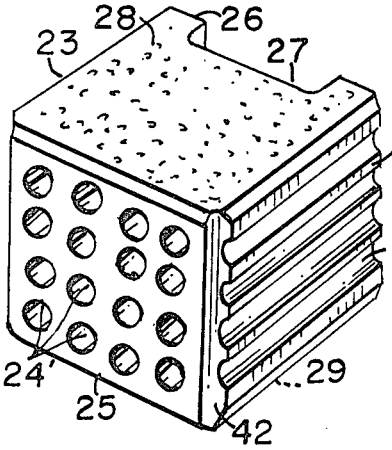
FIG.7
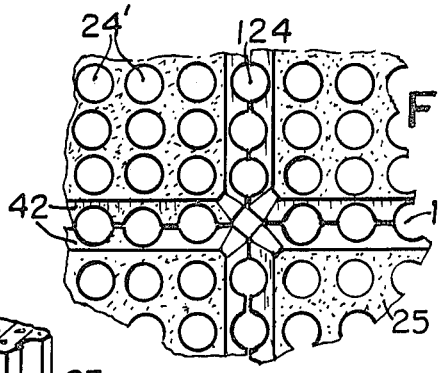
FIG.14
FIG.10
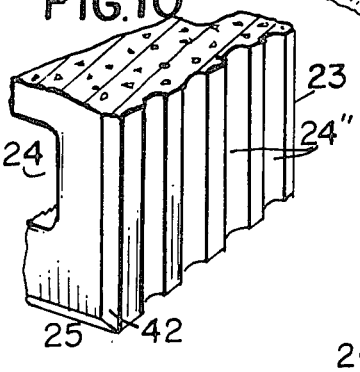
FIG.9
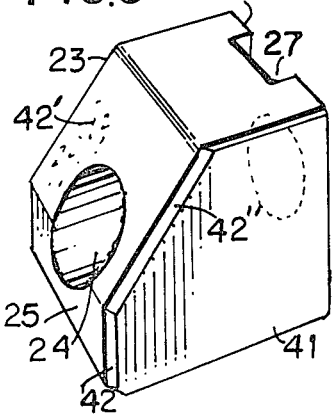
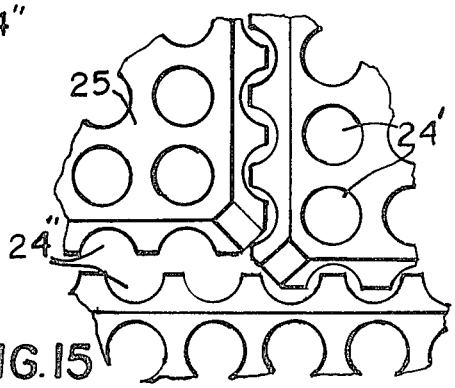
FIG.15

FLOW-GUIDING MONOLITHIC BLOCKS FOR MARINE STRUCTURES

This invention concerns a novel form of concrete body having six sides intended for use in marine works, and more particularly is directed to the provision of unitary cast concrete monoliths of weight from about one tonne to twenty tonnes or more provided with fluid-guiding channels.

Arrays of such bodies are capable of dissipating energy of moving water, whether used as armor capping layers on a rubble mound breakwater, or as anchoring masses stacked as ballast on the bottom wall of the chamber of a monolithic caisson which comprises a section of a horizontally extended breakwater having an apertured seaward-facing wall spaced from a rear wall.

In the construction of a breakwater of extended length of the type described in U.S. Pat. No. 3,118,282 dated Jan. 21, 1964 issued to G. E. Jarlan, it has been found most practical to build sections of the breakwater as floatable units of open box forms in lengths 15 to 50 m. comprising upright front, rear, bracing and end walls integral with a bottom wall. The front wall is extensively perforated by a plurality of regularly-spaced fluid-guiding and jet-forming channels extending transversely arranged in a grid pattern to present a cross-sectional channel area between about 25% to 35% or more of the elevational area. The bottom wall of the chamber is extended as short horizontal flanges respectively projecting beyond the front and rear walls. Such caisson is floatable as a vessel when the channels are closed allowing positioning and settling the section on the seabed or on a mattress of stone laid on the sea-bed, and the weight of the section tends to maintain it immovable under the action of currents and waves impinging the breakwater.

It has been found that although the walls may have thickness dimensions ranging from less than one meter to one meter or more and although the wall heights may be as great as 40 meters or more depending on sea depth at the installation site, the weight of the section may be insufficient to seat it safely so that incipient rocking and/or sliding motions are not developed when large amplitude waves of long period may impinge the front wall. At certain phase angles of the wave motion the free surface elevation of water adjacent the front wall may be several meters higher than the free surface level in the chamber, causing a horizontal thrust to be directed into the front wall. Partial reflection of the incident wave directs additional large horizontal forces against the caisson. As the chamber fills by injection of seawater through the channels the chamber level adjacent the back wall reaches a height above mean sea level, directing additional horizontal force against the rear wall both by applying hydrostatic pressure and by the reversing of water motion, at a time when a considerable thrust is still being exerted against the front wall. The resultant total horizontal force acts at a height nearer to mean sea level than to the bottom wall, producing a moment tending to lift the front wall by rotation of the section about the rear flange. An uplift force acting vertically under the forward part of the bottom wall, due to injection of water under the section, contributes to this moment.

As the phase angle of the wave reaches a value such that the trough is adjacent the front wall, the reverse surge of chamber water directs a thrust against the inside of the front wall, while hydrostatic pressure exerts horizontal thrust directed against the exterior face of the rear wall; at the same time a smaller uplift force acts at a point close to the rear wall. These horizontal forces produce a moment tending to cause a reverse rotational motion about the front flange. These varying horizontal forces tend to induce a rocking of the section.

The alternating moments are countered by the gravity vector of the caisson's weight which acts through a point generally near the mid-width of the chamber, the vertical load being augmented by the hydrostatic pressure due to that portion of the chamber contents which is above mean sea level, and by any added ballasting applied to load the bottom wall of the chamber. The stability of the caisson against sliding and rocking movements at any instant can be shown to depend directly on the ratio of the product of total vertical forces times the coefficient of sliding friction, to the total horizontal forces exerted, and may be expressed numerically as a factor of safety FS, by the relation:

$$FS = \frac{\text{Coefficient of sliding friction}}{\Sigma \text{ horizontal forces}/\Sigma \text{ vertical forces}}$$

For a given set of circumstances, such as a maximum expected wave height and the type of seabed materials or mattress rubble at the site, one may readily calculate for a chosen value of FS, the amount of additional ballasting required per meter of caisson length; for example, to satisfy an FS of 1.1 a ballasting of perhaps 15 tonnes per meter may be indicated, while for an FS of 1.5, the ballasting may require to be 70 or more tonnes per meter.

The construction of a caisson with a sufficient quantity of reinforced concrete built into the bottom wall to meet stability specifications would not only be excessively costly, but would reduce by two or more meters the effective elevational area of the front wall which can be apertured, and would interfere with the reduction of reflection. Moreover, in typically shallow construction areas, the caisson might not be floatable when so loaded. If a permeable ballast of large boulders is deposited on the bottom wall after the caisson is sited, the stability of the pile under vigorous impact by streams of seawater jetting at velocities which may exceed 30 m per second would be poor. Any shift of ballast toward the rear wall jeopardizes the stability of the caisson, and may cause tipping toward the rear.

I have found that the stability of a monolithic caisson of the type described may be ensured and the difficulties of using rock ballast avoided by providing, according to the invention, a novel ballasting of cast concrete monolithic components of six-sided form, each component being a parallelepipedic body of weight between one tonne and about twenty tonnes having at least one transverse fluid-guiding passage extending through the body along a length dimension, the components being placed on the bottom wall of the chamber in ordered arrays with the passages aligned to impose a minimum of interference with water motions developed by incidence of waves.

Such body preferably has meeting faces of two pairs of sides intersecting at right angles, and may advantageously be a hexahedron, specifically a cube or a rectangular prism, or a prism having two end faces parallel with each other and inclined at other than a right angle to one pair of opposed side faces. Each body has an end face which will be designated the front face which is of rectilinear outline and which has recessed therein at least one aperture formed by the intersection with the end face of at least one passage extending through the body and opening into the opposite face which will be designated the rear face.

The body may be formed with a single flow-guiding passage, of dimensions from about 0.5 m to 1 m or greater diameter, and of circular, elliptical, polygonal or other cross-sectional outline with an area from about 0.2 $m^2$ to about 1.5 $m^2$. Alternatively the body may have a plurality of parallely-extending ducts distributed uniformly over the end faces, with a total cross-sectional area about the same as for a single passage. In either form the body is characterised in that a groove recessed into the rear face extends into a pair of opposed side faces and is intersected by the single passage or by some or all of the ducts, to provide flow channels permitting water to move freely in the vertical direction when the bodies are deposited with the passages or ducts horizontal and the grooves extending generally up and down.

When a group of like ballasting components are arrayed in closely-contiguous ranks and files as a layer or two or more stacked layers, with a front face of one block abutting the non-grooved portions of the rear face of the adjacent body of the file, and the passages or ducts are aligned with each other and with the stream flow jetting through the front wall channels, seawater may flow almost without restriction along the passages or ducts as a wave crest approaches, each groove distributing water upwardly to fill the chamber. The chamber water may thereafter discharge freely as the wave trough nears the front wall, along the grooves and passages or ducts.

For minimum impediment to the horizontal flow, the component dimensions are so chosen that an array of like bodies placed as closely-contiguous ranks and files will have their front faces centered on the channel axes, and a single passage is formed in each body with a cross-sectional area comparable to the channel cross-sectional area. The groove depth is so chosen that its cross-sectional area as measured in a horizontal plane will be between one-sixth and about one-third of the passage cross-sectional area. The most forward rank is spaced about one meter from the front wall, while the rear faces of the rearmost rank are spaced a greater distance from the back wall, for example about three meters.

The horizontal flow cross-sectional area provided by such array or stack is enhanced by the inevitable unevenness of abutting planar side faces, and advantageously additional flow cross-sectional area may be realised by forming the side faces with a number of parallel grooves or flutes recessed into the body and extending horizontally or vertically or as intersecting sets of grooves to provide intercommunicating vertical and horizontal flow-guidng spaces between abutting sides similarly shaped.

When a block of the parallelepipedic form described is placed in or upon a marine structure where moving water will impinge the front face, a large mass of seawater can be conveyed along the passage or the plurality of ducts per unit time, under very low head, while the groove effects distribution of the flow laterally. Hence when an array of such blocks is assembled with their front faces presented toward the supply of moving water and their side faces are in abutting relation, very large mass transport can be effected with low head loss, augmented by the flow between contiguous generally-planar sides, and the flow issuing from the rear faces will be distributed over an area greater than the cross-sectional area of the passages or ducts.

Such an array of blocks can therefore be used to advantage for directing and distributing flow of seawater breaking upon a rubble mound breakwater built up of relatively small stone or very coarse gravel, by cladding the entire surface of the mount with an armor capping layer made up by assembling closely-spaced blocks presenting their front end faces to the water and their grooved faces toward the permeable rubble mass. An excellent energy-dissipating action may be achieved using hitherto unusable aggregates piled as highly permeable mount structures, without risk of their washing away, whereas in the absence of such armor capping the mount would be destroyed by only a few large waves.

Another advantageous use of the blocks within the concept above stated, is as a flow-restricting barrier layer when blocks are placed as a strip of closely contiguous units to cover the exposed area of rubble mattress where such layer has been spread on seabed prior to settline the caissons of a concrete breakwater thereupon. By employing blocks in which the ducts provide a low perforation ratio or have been partly obstructed, a diminution of the injected amount of seawater flowing periodically into the mattress material can be achieved without attendant increase of under-pressures, particularly at the toe, thereby reducing effectively the magnitude of uplift forces developed.

The practice of the invention may be more fully understood from the description of its preferred embodiments which follows, to be read in conjunction with the accompanying drawing, wherein:

FIG. 6 is a perspective view in enlarged scale of a group of ballast units of a single layer of the ballasting of FIG. 1;

FIG. 7 is a perspective view of an alternative form of ballast component having a plurality of flow-guiding ducts, and having a pair of faces formed with horizontal grooves;

FIG. 9 shows another ballast component having a front face strongly bevelled;

FIG. 10 is a partial perspective view of another component having a single passage and side walls vertically grooved;

FIGS. 14 and 15 show alternative grouping arrangements of components forming the capping of a breakwater as in FIG. 13;

Figure 16:
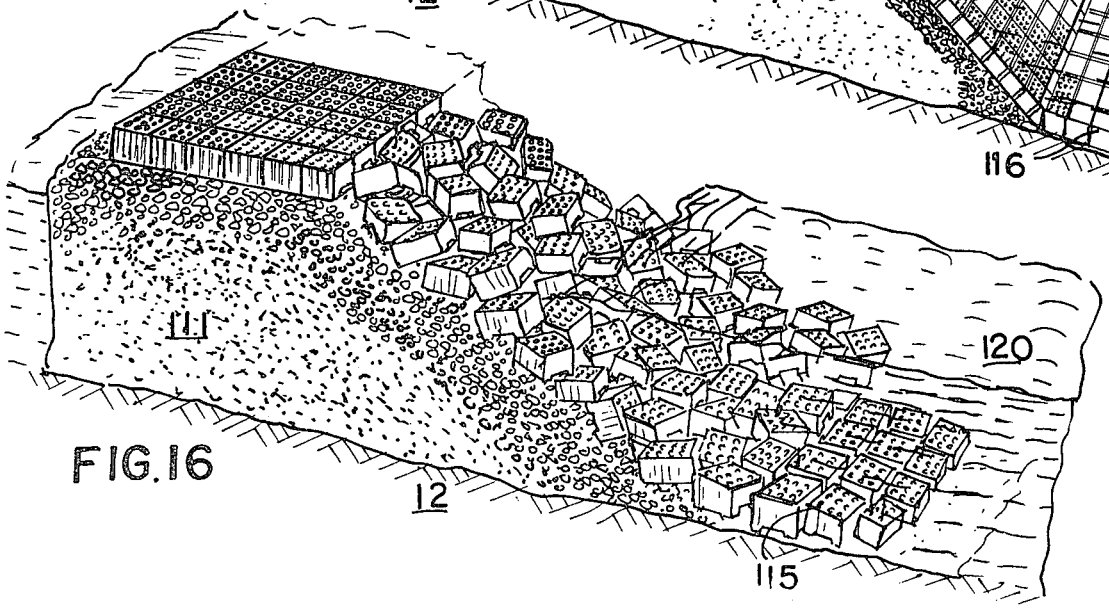

and, FIG. 16 shows an alternative armor capping of the seaward slope of a rubble mound breakwater employing components in random placement.

With reference to the drawing, a horizontally-extended breakwater generally designated at 10 incorporating the ballasting components of the invention comprises a number of like sections such as 10*a*, 10*b*, 10*c*, 10*d*. . . . which are placed in end-to-end abutting relation on a rubble mattress layer 11 deposited on seabed 12. Each section comprises a unitary cast body of reinforced concrete formed as an upwardly open box or caisson, having a perforated upright front wall 13, an upright rear wall 14 and upright end walls 15, and a horizontal bottom wall 16 having short extending flanges 17, 18. The front wall is extensively apertured by a large plurality of regularly-spaced jet-forming and guiding apertures 19 comprised as channels opening through the front wall allowing free transfer of sea-water into and out of chamber 21 defined between the upright walls.

Figure 1:
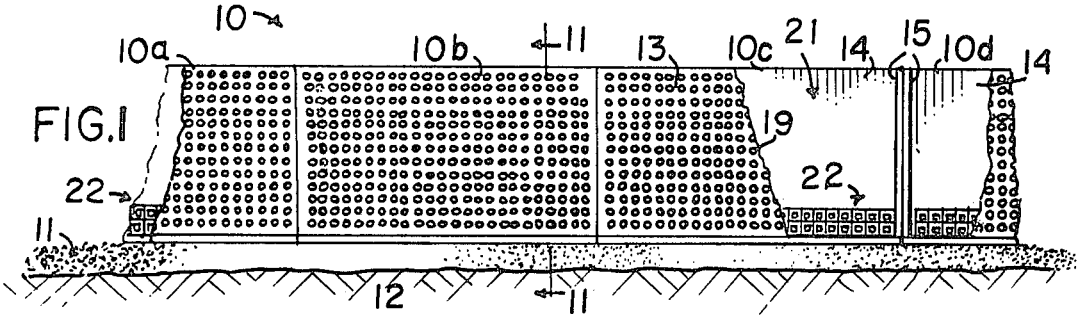
FIG. 1 is a front elevational view partly cut away showing a horizontally-extended breakwater having a ballasting installed in accordance with the invention in each section.
Figure 2:
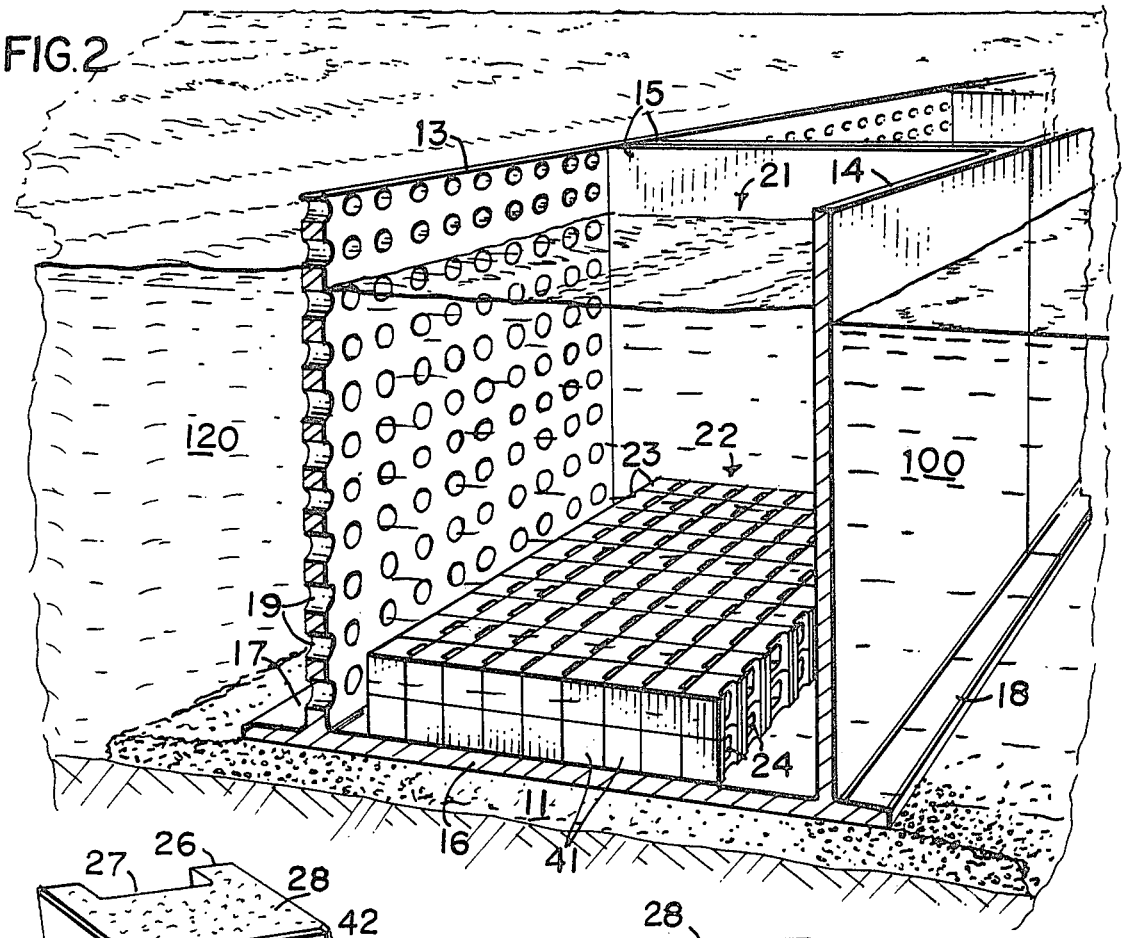
FIG. 2 is a perspective view looking into a caisson shown in FIG. 1, showing in enlarged scale a two-layer ballasting stack.

As may be understood from FIG. 2, a ballasting group 22 comprised as a layer or layers of like parallelepipedic components 23 is supported on bottom wall 16, spaced from the front wall a predetermined distance such as about one meter and spaced from the rear wall a somewhat larger distance, for example about 3 meters. Referring also to FIGS. 5 through 11, a through passage 24 opens into a front face 25 and opens also into an opposed rear face 26 of each component 23.

The rear face 26 has a groove 27 recessed therein, the recessing extending at uniform depth into the component and opening at one end into upper face 28 and opening at its other end into lower or bottom face 29 of the component. The groove 27 has a width such that at least about 30% to about 80% of the rear face is recessed, and has a depth such that the groove cross-sectional area measured on a plane normal to the rear face is between about one-sixth to about one-third of the cross-sectional area of all passages or ducts extending through the component.

Figure 3:
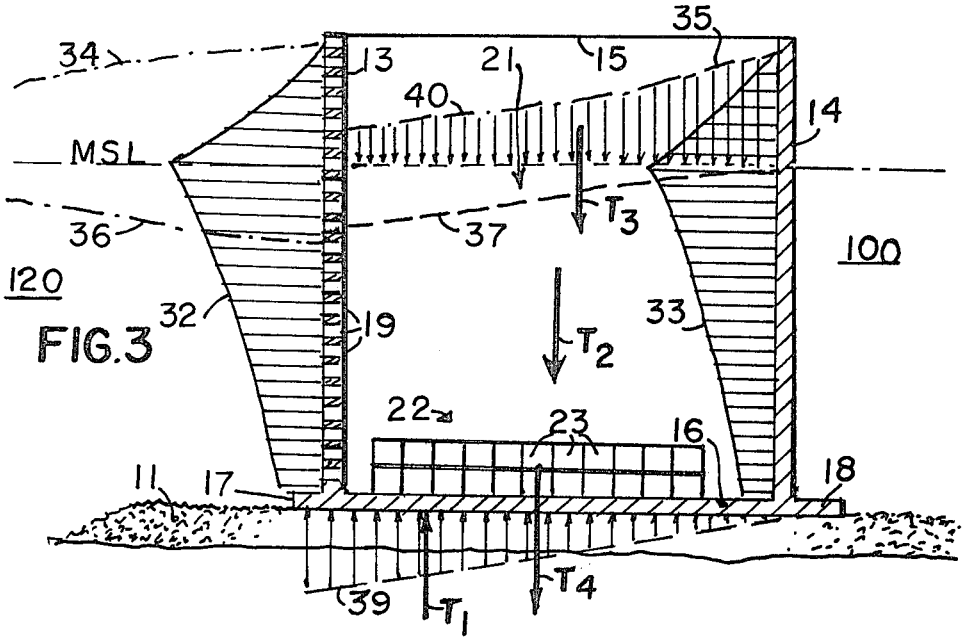
FIG. 3 is a diagram relating wave-induced forces, surge forces, dead weight, and ballasting loads acting on a section.
Figure 4:
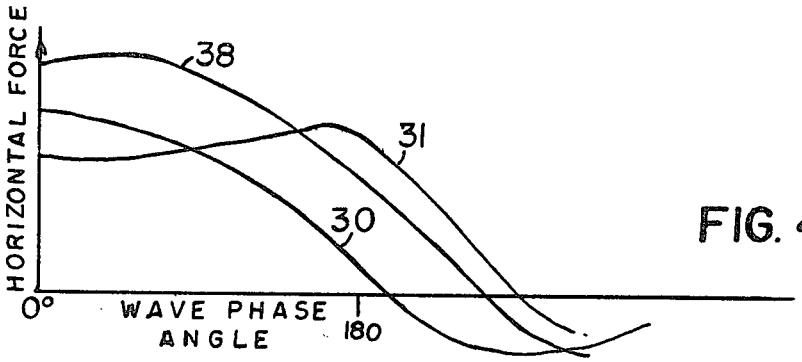
FIG. 4 is a graph relating wave forces to phase angle of a wave of single period.

The magnitude and position of a ballasting load placed on bottom wall 16 to ensure the stability of each caisson on its seabed site as depicted in FIGS. 1, 2, 3 and 11 can be accurately calculated from considerations of the disturbing forces and their points of application on the caisson. For example, the distribution of wave-produced horizontal forces, and their instantaneous overturning moments, augmented by uplift forces, can be diagrammed as shown in FIG. 3, together with vertical loadings due to caisson weight, super-elevated chamber water, and ballasting. In a particular location where it may be known that the maximum wave force that can be expected from the seaward side of the breakwater corresponds to the thrust of a wave of 12 m height from crest to trough, having a period of 10 seconds, the instantaneous total horizontal forces on the front wall and on the interior of the rear wall can be depicted by the respective curves 30 and 31 of FIG. 4, plotted against wave phase angle. In the diagram, the zero point of the abscissa is assigned to the moment when the crest arrives at the front wall.

The distribution of the forces may be shown by the trapezoidal outlines 32 and 33 enveloping the distributed unit vector thrust forces acting on the vertical surfaces of the front and rear walls. The peak horizontal force at Mean Sea Level (MSL) at the front wall for a specific wave may, for example, be found to be 6 tonnes per square meter and the surge pressures at the rear wall may have a maximum value of about 8 tonnes per square meter, the latter occurring perhaps 3 seconds later than the front wall peak. The horizontal forces become zero at the highest water line 34 on the seaward side, and at the highest surge crest line 35 at the rear wall. The horizontal forces diminish to about 2.6 tonnes per square meter at the toe adjacent front flange 17 and to about 4 tonnes per square meter at the chamber bottom adjacent rear wall 14.

A combination of horizontal thrust forces acting on the caisson structure at any instant, as shown by composite curve 38, may reach a maximum value when the wave angle is about 80 degrees, and the overturning moment due to such peak can be readily found. In addition, hydrostatic pressure acting on rubble mattress 11 which is inherently permeable, injects water under the caisson, developing a distributed uplift force acting upwardly on the underside of bottom wall 16 and flanges 17, 18, as diagrammed by the enevelope outline 39 of the distributed vector forces. The vector sum may be represented by a single force $T_1$ which acts within the forward one-third portion of the chamber width.

The caisson's immersed weight may be represented by the single vertical force $T_2$ which acts at about the mid-width point. An additional vertical load is imposed on the chamber bottom by super-elevated water in the chamber, that is, water momentarily elevated above MSL, as depicted by outline 40 of distributed vector unit forces representable by single vertical force $T_3$. When the chamber water surface is below MSL an uplift component must be ascribed.

By appropriate consideration of all these time-varying forces throughout all wave phase angles, the magnitude of the required ballast to satisfy a specified factor of safety FS can be determined, for instance the single vertical load force $T_4$. Such load is conveniently expressed as a requred loading in tonnes per meter of caisson length, and may range from about 20 to 150 tonnes or more. Such load should preferably be directed within the middle one-third width portion of the chamber bottom wall, because improved stability of the caisson is correlateable with reduction of eccentricity of the ballasting load. In areas where earthquakes may be expected the ballast load should be directed close to the mid-width point. It must be noted that in calculating the ballast, it is the immersed weight of components which has to be considered, and the design and placement of the components has to consider also the horizontal forces due to jetting of seawater through channel openings 19, which would tend to dislodge or overturn ballasting components confronting such stream flow, of velocities in excess of 30 m per second.

Figure 5:
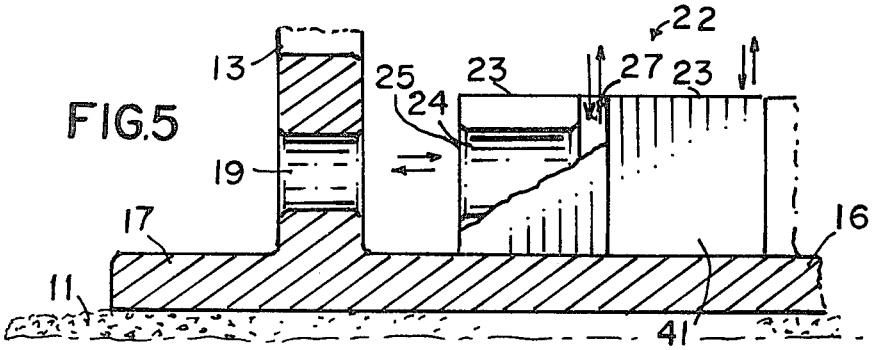
FIG. 5 is a side elevational view partly in section of ballast components in relation to jet-guiding channels of a breakwater as shown in FIG. 2.

Referring particularly to FIG. 5, a preferred form of ballasting component 23 is a unitary cast concrete parallelepipedic monolith of prismatic form, preferably a rectangular or cubic solid body. As concrete has a density about 2.4 the net immersed density falls to 1.4. A typical component may be a cube of side 1. meter to 2 meters or more. When the front wall 13 has an aperturing ratio from about 25% to 35% and each channel has a diameter about one meter, which dimensions have been found to ensure highest efficiency for conversion of wave energy to kinetic energy of guided stream flow, the minimum cross-sectional area of a passage or passages 24 should represent an aperturing ratio of front face 25 not less than this ratio. Consequently the effective immersed weights of such blocks will range between one tonne to 12 tonnes or more. An advantageous form of unit of 1.7 m side has a ballasting weight of about 5 tonnes, providing about 2.8 tonnes per meter length.

To reduce adverse effects on mass transport of seawater ballasting group 12 should impede stream flow of jets as little as possible, hence the area of a passage 24 or group of passages shaped as parallel ducts should match or exceed the stream cross-sectional area and the passage should be aligned parallel with the current. An optimum form therefore has dimensions such that the forward rank of components may be arrayed in side-by-side abutting contiguous relation and each channel 19 has its axis extended generally coaxial with or centered on a respective passage 24.

Alternatively, a component as shown in FIG. 7 having a large plurality of parallel through ducts 24' with combined cross-sectional area from 30% to 40% or more of the front face area may be employed.

As evident from FIGS. 2 and 4, there may be a considerable number of components in a file, hence friction drag due to the series of passages along which seawater is guided can significantly impede the stream flow. Additionally, the discharge of seawater toward rear wall 14 further impedes such flow. The ballasting according to the invention avoids these impediments by providing vertically-extending grooves 27 intersecting each passage 24, or some or all of the ducts 24', to allow free upward distribution of injected flow to the chamber, and gradual reduction of velocity along the file while seawater is streaming into the chamber. Conversely, outflow of chamber water is facilitated.

Figure 8:
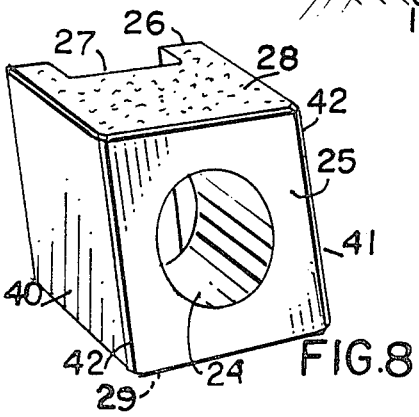
FIG. 8 is a perspective view of a parallelepipedic component having front and rear faces inclined to the top and bottom faces at other than a right angle.

While cubic or rectangular components will generally be preferred to facilitate stacking in layers, a prismatic form as shown in FIG. 8 is useful, wherein front and rear faces 25, 26 are parallel and inclined to top and bottom faces 28, 29 at an angle other than a right angle, for example at 60 to 80 degrees, particularly where the preferred stack form (not shown) is desired to have an upwardly-inwardly inclined group front face. In such component the side faces 40, 41 are plane and generally parellel, within the limits of conventional concrete casting processes, and are disposed at right angles to top and bottom faces 28, 29.

Some or all of the meeting faces of a component are preferably bevelled at about 45 degrees wth respect to each intersecting face, to improve the durability of a component during handling, as indicated by bevelled edges 42. The bevelling may be further accentuated as shown in FIG. 9 so that top face 28 and front face 25 are significantly diminished, by a wide bevel face 42', which partly intersects the through passage 24. The meeting edges of bevel face 42' and a side face 40 or 41 are further bevelled as at 42''. Such components may be usefully employed with other cubic components as shown in FIG. 11 to form a stack with a sloping frontal face, and for rubble mound breakwaters as will be described later.

Figure 12:
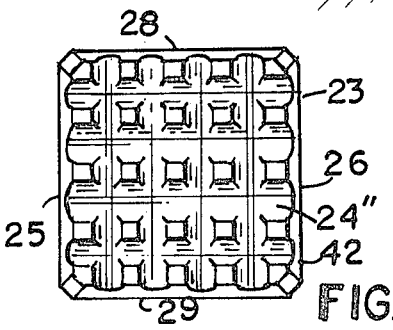
FIG. 12 is a side elevational view of a modified ballasting component having an opposed pair of faces formed with intersecting sets of horizontal and vertical grooves.

Referring also to FIGS. 7, 10, 12, 14 and 15, the components may have their front faces 25 apertured along their margins to form partial ducts 24'' on some or all of the side and top and bottom faces, so that an array of closely-contiguous components having such partial ducts presented toward each other provides additional cross-sectional flow passages. The partial ducts may extend either in the same direction as the ducts 24', or they may extend at right angles thereto. As shown in FIG. 12, the side faces 40, 41 may be formed with crossing sets of such partial ducts, providing for vertical flow distribution equivalent to that provided by rear face grooves 27.

Figure 11:
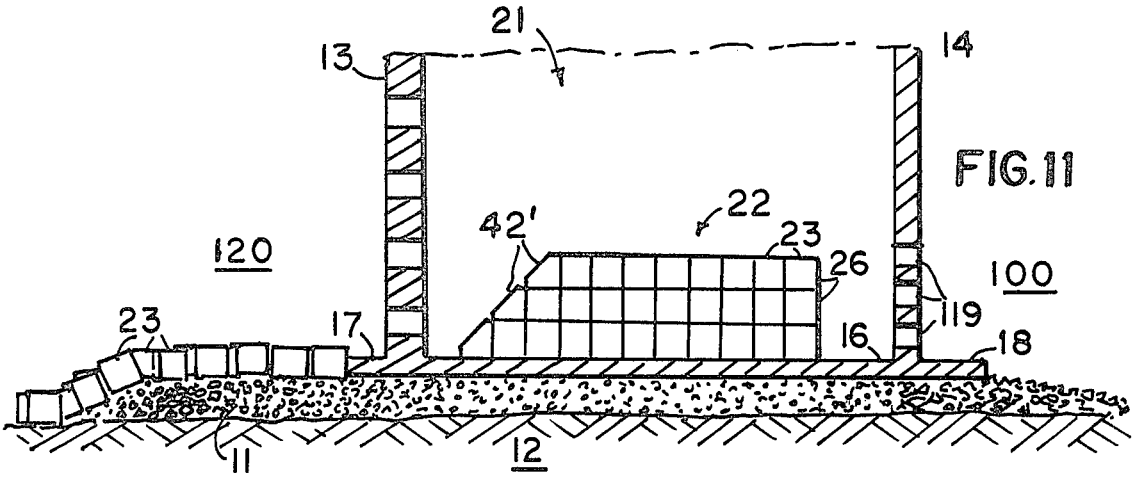
FIG. 11 is an elevational view showing in vertical cross-section on a plane designated 11—11 through the breakwater of FIG. 1, showing a ballasting comprised both of cubic and bevelled blocks, and showing armoring of a rubble mattress by a capping of ballast.

The ballast components have utility when deposited upon a rubble mattress 11 adjacent the front wall of the breakwater as a means to reduce the volume of seawater injected under the bottom wall 16, as shown in FIG. 11. A more or less continuous sheet of blocks provides a barrier layer diminishing the downward flow of water under the hydrostatic head of a wave crest into the rubble layer 11, thereby decreasing the magnitude of uplift forces. This diminution is particularly effective when a relatively fine rubble ballast is deposited on the sheet so as to reduce the effective cross-sectional area of the ducts in the components, as well as to reduce the area of spaces between adjacent components. At the same time scouring of the seabed adjacent the front flange 17 is prevented when the highest waves impinge the breakwater.

As shown in FIG. 11, the ballasting is useful also in breakwaters of the type providing for ventilation of the protected lagoon or harbour 100 which the breakwater is intended to shield from wave action, as where a number of through channels 119 open through the rear wall 14 to periodically inject water from chamber 21 into lagoon 100. The transverse flow of seawater from the seaward side 120 is guided with little velocity decrease toward the rear wall and thence through the channels 119, thereby maximizing the injected volume within any wave period, as compared with breakwaters not provided with such stream-guiding ballasting.

Figure 13:
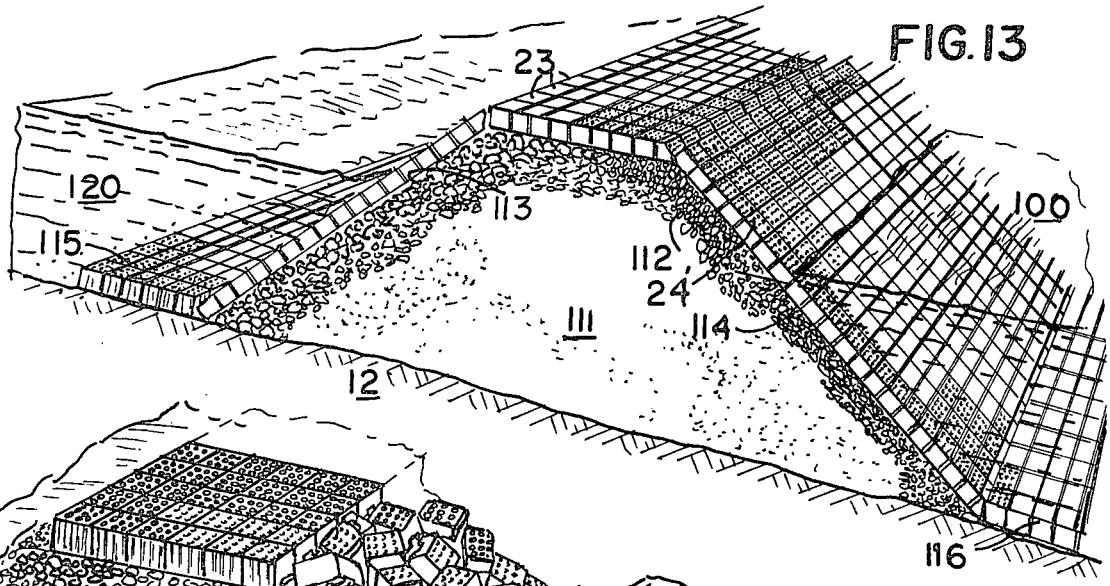
FIG. 13 is a perspective view partly in vertical section through a rubble mound breakwater having an armor capping formed by ordered arrays of ballast components.

The properties of the ballasting components 23 according to the invention are particularly advantageous when large numbers of them are fitted on prepared surface areas of a rubble mound breakwater generally indicated at 110 shown in FIG. 13, as an armor capping layer or layers. Such rubble mound breakwater may comprise, as a major volume core portion 111, relatively fine aggregates hitherto regarded as unsuitable for construction of brakwaters, such as coarse sands and gravels piled on seabed 11 at a deep water site in the sea, and shaped as a flat-topped mound with sloping faces at the natural rest angle of the materials. An outer deposit 112 comprised of highly-permeable stone of moderate sizes, for example rubble and boulders of sizes generally below one tonne dry weight and including rock smaller than 100 kilograms, is formed as a layer of thickness from 5 to 12 meters. The deposit is smoothed, as by dragging suitable scrapers or drags, to provide surfaces which are generally planar respectively sloping downwardly-seawardly and downwardly-landwardly as inclines 113, 114. These inclined faces are shaped to lie with an included angle with respect to seabed somewhat smaller than the rest angle of rubble piled in water.

The components 23, which are preferably formed with a plurality of through ducts 24', including marginal partial ducts 24'' on four faces of the component which intersect the front face 25, are laid on seabed as aprons 115, 116 on either side of the core and stone deposits. Such aprons may comprise more than one layer (not shown) depending on the unit weights of components employed.

The components may be laid in the manner depicted in FIG. 14, to present partial ducts 24″in opposed registration to form ducts 124 thereby, or, some side faces may be interlocked with adjacent side faces as shown in FIG. 15, thereby enhancing the resistance to displacement under the forces of spillflow. Such partial interlocking decreases the effective cross-sectional area of those marginal partial ducts which interlock, but widens the cross-sectional area of certain other partial ducts, as at 124′.

The armor cladding of components in closely-spaced abutting relation, each component presenting its grooved rear or under face 26 toward the stone deposit 112, provides an optimum distribution of moving sea water into the interstices of the deposit. As a breaking wave approaches the seaward slope, a large mass transport action transfers the spillflow through the ballasting components as highly-aerated, high-velocity jets, which enter freely the openings between the boulders, and flow therebetween converting energy of water motion to heat. The grooves 27 spread the flow effectively. As the sea recedes, water flows outwardly and downwardly freely, as a large volume outwelling characterised by low velocity, well below an entraining velocity for he stone of which deposit 112 is formed, and insufficient to lift the ballast component. Consequently, the materials of the core and of the stone deposit are not subjected at any time to concentrated stream flow capable of displacing the materials, and the breakwater stands stably.

While heretofore great stones have been required for armor capping, of the order of 20 tonnes or larger, to withstand the forces of moving water, concrete components as described may be relatively lighter, for example between 2 tonnes and 14 tonnes. The economies of construction, and the durability of the structure, are directly related to the capability of the arrays to dissipate energy of moving water effectively.

An alternative form of rubble mound breakwater shown in FIG. 16, or which only a flat top and inclined seaward slope portion are depicted, utilises the energy-dissipating capabilities of the ballst components when randomly piled on a stone deposit. Such arrangement requires generally a larger tonnage or ballast per unit area for assuring durability; nevertheless random or jumble placement facilitates more rapid completion at lower labour costs.

It is always possible to utilize the construction of FIG. 16 as a prelimimary stage, for early protection of the mound materials, allowing later lifting and replacing of the components to form the breakwater of FIG. 13.

I claim:

1. A monolithic block for dissipating energy of water motion when exposed as an ordered array of a plurality of blocks exposed to the sea, comprising a six-sided body of between one tonne and 20 tonnes weight having one face to be disposed for impingement by sea water and an opposite face spaced from said one face, said one face having recessed therein at least one aperture defined by the intersection with said one face of at least one passage extending through the block and opening into said opposite face, a first pair of faces parallel with each other and intersecting said one face, a second pair of faces parallel with each other and perpendicular to said first pair of faces and intersecting said one face, the said opposite face having recessed therealong a groove, said groove intersecting said at least one passage and intersecting one pair of said pairs of faces, at least portions of the faces of said pairs being disposed in bounding planes defining the body sides.

2. A monolithic component as claimed in claim 1 wherein said one face and said opposite face are generally parallel with each other and each is inclined at an angle other tha a right angle with respect to the one pair of faces intersected by said groove.

3. A monolithic component as claimed in claim 1 wherein said body is a hexahedron wherein all faces are generally perpendicular to intersecting faces.

4. A monolithic component as claimed in claim 3 wherein said at least one passage comproses a plurality of ducts extending in parallel relation to each other and said groove intersects at least some of said ducts.

5. A monolithic component as claimed in claim 3 wherein the total cross-sectional area of said at least one passage is between about 0.2 $m^2$ and 1.5 $m^2$ and said at least one pasage comprises a single duct of cross-sectional outline selected from the outlines consisting of circular, elliptical, and polygonal.

6. A monolithic component as claimed in claim 4 wherein the total cross-sectional area of said at least one passage is between about 0.2 $m^2$ and 1.5 $m^2$ and said at least one passage comprises a plurality of ducts extending in parallel relation to each other, and said groove intersects at least some or all of said ducts, the combined cross-sectional area of all said ducts being between about 20% and 35% of the area of said one face.

7. A monolithic component as claimed in claim 3 wherein the body is formed as a unitary cast concrete structure, and the faces of said pairs comprise a predominance of elemental areas disposed inwardly from the bounding plane defining the face.

8. A monolithic componenet as claimed in claim 3 wherein the body is formed as a thick-walled precast concrete tube having cast about the tube a concrete mass, and wherein the faces of said pairs comprise a predominance of elemental areas disposed inwardly from the bounding plane defining the face.

9. A ballasting for a concrete caisson of the type having an upright front wall, an upright rear wall, a pair of upright end walls, and a planar bottom wall integrally connected with said upright walls to form a unitary section of a breakwater, said front wall being extensively perforated by a large plurality of jet-forming channels having horizontal axes opening through said front wall, the ballasting comprising a group of parallelipipedic bodies of like size and form of weight between one tonne and twenty tonnes, each said body having one face of rectilinear outline having recessed therein at least one apertured defined by at least one passage extending through the block and opening into an opposite face, two pairs of side faces meeting at right angles, the said opposite face recessed therein a groove, said groove intersecting said at least one passage and intersecting one pair of said group of bodies being disposed on sad bottom wall between said front and rear walls as ranks and files with the said at least one passage of each body of the same file aligned with the axes of channels of said front wall and with the grooves of all bodies in the vertical.

10. A ballasting for a concrete caisson as claimed in claim 9 wherein the said at least one passage comprises a single duct of cross-sectional area from 0.2 $m^2$ to 1.5 $m^2$ generally centered on the cross-section of the body and the channel spacings and positions on the front wall and the body dimensions are so chosen that the channel axes extend along the aligned passages of the files of said ballasting.

11. A ballasting for a concrete caisson as claimed in claim 10 wherin the bodies are assembled as at least one layer in ranks and files in closely spaced abutting contiguous relation, wherein the nearest rank is spaced from the front wall a predetermined distance and the bodies closest to the rear wall are spaced therefrom a distance greater than said predetermined distance.

12. A ballasting for a concrete caisson as claimed in claim 10 wherein the bodies are assembled as two or more stacked layers with the bodies of a layer disposed in ranks and files in closely abutting contiguous relation wherein the grooves of a body supported on a lower body are in vertical alignment, and the nearest ranks are spaced a predetermined distance from said front wall and the bodies closest to the rear wall are spaced therefrom a distance greater than said predetermined distance.

13. A ballasting for a breakwater of the rubble mound type comprising a shaped pile of aggregate rock materials having a generally flat top face and front and rear sloping faces, the ballasting comprising at least one layer of parallelepipedic bodies of like size and form of weight between about one tonne and bout fourteen tons assembled as a capping covering all said rubble faces, each said body having one face of recti-linearoutline having recessed therein a plurality of regularly-spaced apertures defined by a corresponding plurality of ducts extending through the body parallel with each other and opening into an opposite face, two pairs of side faces meeting at right angles, the said opposite face having recessed therein a groove, said groove intersecting at least some or all of said ducts, and intersecting at least one pair of said pairs of side faces, said group of bodies being disposed with their said one faces presented outwardly and their said grooved faces presented toward the rubble mass, adjacent bodies being in closely abutting contiguous relation.

14. A ballasting for a breakwater as claimed in claim 13 wherein said plurality of ducts have a total cross-sectional area between about 0.2 $m^2$ and about 1.5 $m^2$ and the maximum cross-sectional dimension of any duct is about 25 cm.

15. A ballasting for a breakwater as claimed in claim 14 wherein the body is formed as a unitary cast concrete structure and said faces of said pairs comprise a predominance of elemental areas disposed inwardly from a bounding plane defining a respective face.

16. A ballasting for a breakwater as claimed in claim 15 wherein said faces of said side pairs of faces are recessed by a plurality of grooves extending to and intersecting meeting faces.

17. A ballasting for a breakwater as claimed in claim 16 wherein said plurality of grooves comprise grooves extending between said one face and said opposite faces.

18. A ballasting for a breakwater as claimed in claim 13 wherein said bodies have those meeting edges formed by side faces intersecting said one face bevelled at about 45 degrees with respect to the plane of said one face.

19. A ballasting for a breakwater as claimed in claim 13 wherein the meeting edges of all side faces are bevelled at about 45 degrees.

20. A ballasting for a marine structure of the type comprising a concrete caisson having an upright front wall, an upright rear wall, a pair of upright end walls, and a planar bottom wall integrally joined with said upright walls having flanges extending beyond and integrally joined to said bottom wall adjacent said front and rear walls, said front wall being extensively apertured by a larger plurality of jet-forming channels having horizontal axes opening throug said front wall, said section resting on a prepared rubble mattress comprised of stones placed as a layer on seabed as a strip of width greater than the width of said bottom wall including said flanges, said ballasting comprising a group of parallelepipedic bodies of weight between one tonne and about fourteen tonnes, each said body having one face of rectilinear outline having recessed therein a plurality of apertures defined by a corresponding plurality of ducts extending through said body and opening into an opposite face, two pairs of side faces meeting at right angles, the said opposite face having recessed therein a groove, said groove intersecting some or all of said pairs of side faces, the said group of bodies being disposed as a cladding resting on the exposed portion of the mattress layer with the one faces of the bodies presented upwardly.

21. A monolithic component as claimed in claim 3 wherein said at least one passage comprises a plurality of ducts extending in parallel relation to each other and some of said ducts open along faces of at least one pair of said faces.

22. A monolithic block as claimed in claim 1 wherein at least a portion of said one face is inclined at an angle other than a right angle with respect to said opposite face.

* * * * *